US006923255B2

(12) United States Patent
Lee

(10) Patent No.: US 6,923,255 B2
(45) Date of Patent: Aug. 2, 2005

(54) ACTIVATING BALL ASSEMBLY FOR USE WITH A BY-PASS TOOL IN A DRILL STRING

(76) Inventor: Paul Bernard Lee, 15 Blueridge Place, Calgary (CA), T3L 2Ns ( * ) Notice: Subject to any disclaimer, the term of this patent is extended or adjusted under 35 U.S.C. 154(b) by 54 days.

(21) Appl. No.: 10/344,732

(22) PCT Filed: Aug. 2, 2001

(86) PCT No.: PCT/GB01/03492

§ 371 (c)(1),
(2), (4) Date: May 19, 2003

(87) PCT Pub. No.: WO02/14650

PCT Pub. Date: Feb. 21, 2002

(65) Prior Publication Data

US 2004/0011566 A1 Jan. 22, 2004

(30) Foreign Application Priority Data

Aug. 12, 2000 (GB) ..... 0019800
Sep. 7, 2000 (GB) ..... 0021913

(51) Int. Cl.[7] ..... E21B 33/00
(52) U.S. Cl. ..... 166/154; 166/318
(58) Field of Search ..... 166/154, 155, 166/318, 332.4, 239, 170, 334.4; 137/529, 533

(56) References Cited

U.S. PATENT DOCUMENTS 1,364,084 A * 1/1921 Dodds ..... 175/317
1,908,762 A 5/1933 Fowler et al.
2,312,018 A 2/1943 Beckman
2,493,650 A * 1/1950 Baker et al. ..... 166/194
2,627,314 A * 2/1953 Baker et al. ..... 166/156
2,633,916 A * 4/1953 Baker et al. ..... 166/155
2,740,480 A * 4/1956 Cox ..... 166/170
3,338,311 A * 8/1967 Conrad ..... 166/154
4,889,199 A 12/1989 Lee
6,189,618 B1 2/2001 McClung et al.
6,464,008 B1 * 10/2002 Roddy et al. ..... 166/285

* cited by examiner

*Primary Examiner*—William Neuder
(74) *Attorney, Agent, or Firm*—Madson & Metcalf

(57) ABSTRACT

A by-pass tool to be incorporated in a drill string, in combination with an activating ball assembly operative to adjust the tool between an activated mode and a de-activated mode. The tool has a valve seat engageable by the activating ball assembly to move its sleeve to a by-pass mode which diverts drilling mud from flowing through the housing to a by-pass flow through the by-pass port. The activating ball assembly has a deformable ball of a size sufficient to engage and to be held captive by the salve seat and a weight attached to the ball and operative to assist in movement of the assembly under the action of gravity to engage the ball with the valve seat. The weight has smaller transverse dimensions that the ball so that it moves downwardly through the valve seat and pulls the ball into engagement with the valve seat.

24 Claims, 6 Drawing Sheets

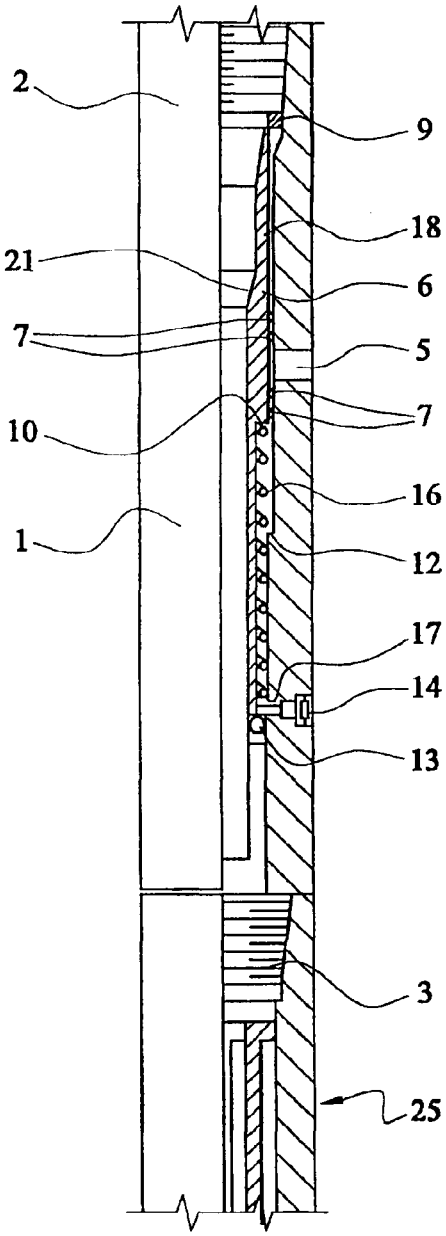
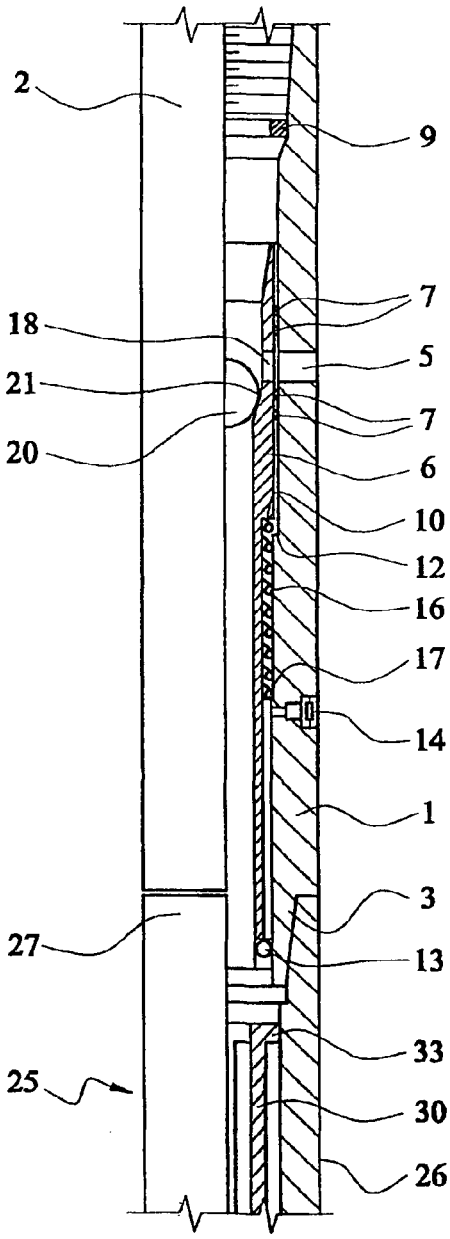
PRIOR ART
FIG. 1
FIG. 2

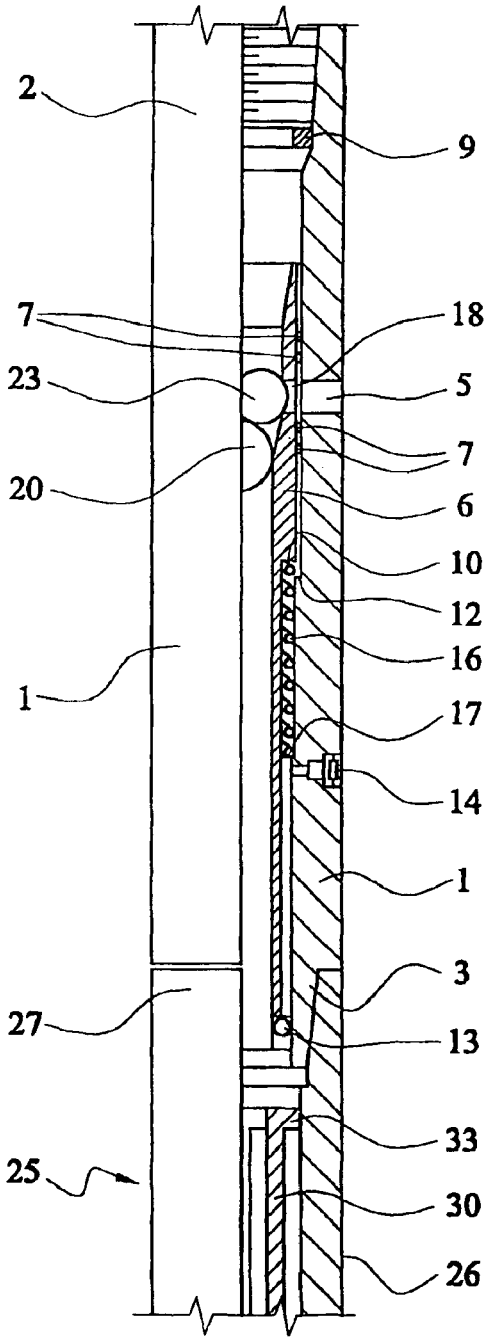
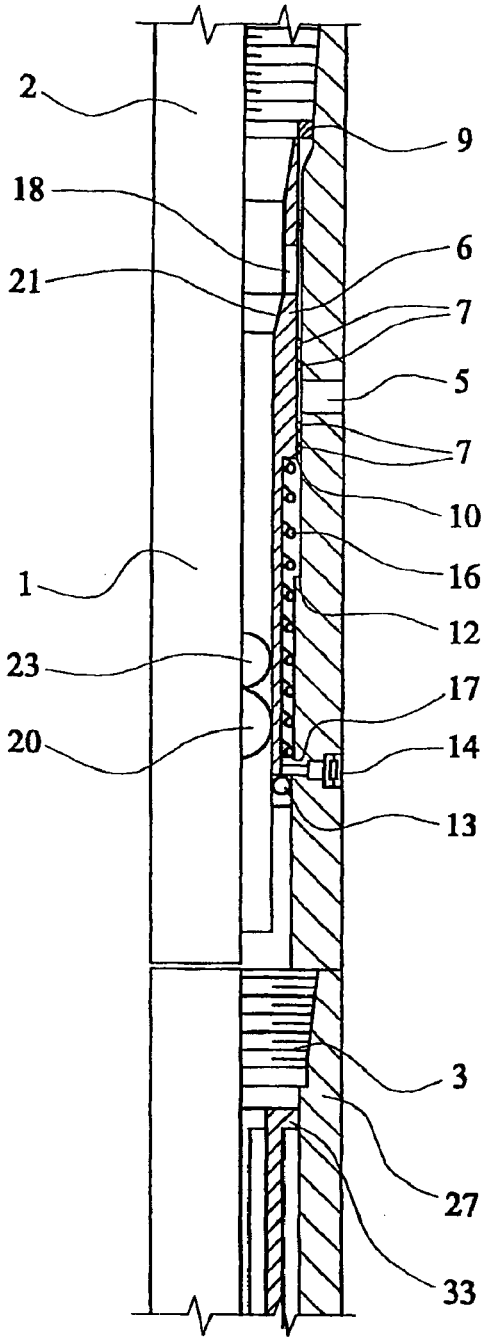
PRIOR ART
FIG. 3
FIG. 4

ACTIVATING BALL ASSEMBLY FOR USE WITH A BY-PASS TOOL IN A DRILL STRING

BACKGROUND OF THE INVENTION

This invention relates to a ball assembly for use in activating a by-pass tool in a drill string.

During drilling through the earth's crust in order to reach underground reservoirs of hydrocarbons (gas and/or oil), it is usual to employ a so-called "drill string, and which is driven from the surface, and has a drilling bit on its lower end. It is also usual to employ drilling mud which is conveyed from the surface to the drilling bit via the drill string, in order to lubricate and cool the bit, but which then returns to the surface via the annulus between the drill string and the usual surrounding casing, and also conveying to surface at the same time the "cuttings" formed during the drilling operation.

During typical drilling operations, problems often arise because of differences in the pressures in the geological formation being drilled and at the surface, or between the pressure of the drilling mud and the formation pressure. Major problems arising out of this include blow-outs, differential sticking and mud circulation loss. Any of these problems can be very dangerous, and often require expensive solutions.

A preferred solution to the problem is to provide a by-pass tool in the drill string, and which includes a through-flow housing through which the mud can flow, and then onwards to the drilling bit, when the tool is operating in a normal de-activated mode. However, when a problem arises (e.g. a lost circulation condition, when drilling fluid is being lost to the formation, and it is desired to inject lost circulation material into the formation), the tool is then activated so that the drilling mud is diverted laterally through a by-pass port in the wall of the housing, and no longer flows downwardly through the housing.

In order to activate the by-pass tool, it is known to use an activating ball which is launched down the drill string from the surface, and which moves down the drill string until it comes into engagement with a valve seat in the tool. This then activates the tool, so that drilling mud in the drill string above the tool can no longer flow downwardly through the tool, but is diverted laterally through the by-pass port.

One example of such an arrangement is disclosed in U.S. Pat. No. 4,889,199, and in which the activating ball is a large deformable ball made of plastics material, and which engages the valve seat (which is provided in a linearly displaceable control sleeve forming part of the tool), and as the mud pressure above the ball builds-up, the ball urges the sleeve downwardly against spring biassing, and so as to allow access for the mud to the by-pass port.

When it is required to de-activate the tool, a second small (and hard) ball is launched down the drill string, and which comes to rest above the larger deformable ball and at the same time blocks access to the by-pass port This stops the transverse by-pass flow of mud, and therefore the pressure above the ball again increases, and when it reaches a certain level, the larger ball is deformed inwardly so that both balls can now pass downwardly through the tool (usually to be received by a lower ball catcher device). The control sleeve then returns under its spring biassing to its original position, so that through-flow of mud lengthwise of the housing can resume.

The use of an activating ball (the large deformable ball) and the de-activating ball (the small hard ball) works very well in practice, and is a very useful feature available to drilling operators. However, while the large deformable ball is well able to move downwardly of the drill string to engage the valve seat when there is pumped mud pressure available in the drill string above the ball, it is much slower in its movement when pumped pressure is not available. In such a situation, the ball can then move downwardly under gravity action only, and therefore moves more slowly before it comes into engagement with the valve seat.

BRIEF SUMMARY OF THE INVENTION

The present invention has therefore been developed primarily with a view to facilitating improved launching of an activating ball down the drill string, by enhancing the effect of gravity on the ball.

According to one aspect of the invention there is provided an activating ball assembly for use with a by-pass tool incorporated in a drill string, said tool having:

a through-flow housing through which drilling mud can flow when the tool is de-activated;

a control sleeve movable lengthwise of the tool between a through-flow mode and a by-pass mode;

a by-pass port in the tool through which mud can flow when the sleeve is in its by-pass mode;

and a valve seat which is engageable by the activating ball assembly in order to move its sleeve to its by-pass mode and thereby divert the mud from flow through the housing to by-pass flow through the by-pass port;

and in which the activating ball assembly comprises:

a deformable ball of a size sufficient to engage and to be held captive by the valve seat; and a weight attached to the ball and operative to assist in movement of the assembly under the action of gravity to engage the ball with the valve seat, said weight being of smaller transverse dimensions than the ball so as to be capable of moving downwardly through the valve seat and to pull the ball into engagement with the valve seat.

In a preferred arrangement, the weight is solid and un-deformable, and may take the form of a "dart" when attached to the ball.

The weight may have outwardly projecting fins which increase its overall transverse dimensions i.e. to project laterally outwardly by a greater extent than the diameter of the valve seat. However, the fins are made to be at least partly deformable so that the weight plus the fins can pass downwardly through the valve seat.

The fins may be made of elastomeric material, and function as wiper blades during the descent of the ball assembly down the drill string and/or down through the valve seat.

The ball is preferably hollow, and in one embodiment is able to make a complete seal preventing through-flow passage of fluid (mud) through the housing, and divert all of the fluid to flow via the by-pass port. However, in some circumstances it may be desirable to permit a limited proportion of the fluid to continue to flow through the passage, although a major portion of the fluid is directed to the by-pass port. This may be advantageous when the ball assembly is used for drilling or maintained work on previously drilled wells.

Therefore, in a second embodiment, an open ended narrow passage may be provided which extends lengthwise of the ball assembly between an inlet end in the ball and an outlet end in the weight.

In a third embodiment, means may be provided on the ball to facilitate unseating of the ball, if desired, by use of a wireline—delivered retrieval tool. In a simple form, a suitable hook-shape may project from one side of the ball which is opposite to the side of the ball to which the weight is attached. The hook shape may be formed by a so-called "fishing neck".

In a fourth embodiment; the weight may be provided with a laterally projecting baffle which facilitates pump-driven conveyance of the ball assembly, which is particularly useful when the drill string follows a non-vertical path, and including in particular a horizontal or near horizontal path. The baffle is resiliently deformable, and therefore allows the weight to be forced downwardly through the valve seat in order to bring the ball into engagement with the seat.

In a fifth embodiment, the ball and weight assembly may have a lock split ring provided on it to allow the assembly to be pumped into the tool down-hole. When the assembly reaches the tool, the split ring will deform when passing through the valve seat and lock the assembly into the seat. This will be effective in the locking of the by-pass system. With the locking by-pass system, the port is locked open until the ball is blown through the seat and deactivates the tool. If the ball seat assembly is not secured to the seat, it comes out of the seat and plugs the port. This would be detrimental to the operation, if it should be desired to pump through the port. This embodiment will therefore be very effective in keeping the assembly in the seat, and not in the port, when the drill string is non-vertical e.g. horizontal.

According to a further aspect of the invention there is provided a by-pass tool that is intended to be incorporated in a drill string. The by-pass tool is used in combination with an activating ball assembly that is operative to adjust the tool between an activated mode and a de-activated mode. The by-pass tool includes a through-flow housing through which drilling mud can flow when the tool is deactivated, a control sleeve movable lengthwise of the tool between a though-flow mode and a by-pass mode, a by-pass port in the tool through which mud can flow when the sleeve is in its by-pass mode, and a valve seat. The valve seat is engageable by the activating ball assembly in order to move its sleeve to its by-pass mode and thereby divert the mud from flow through the housing to by-pass flow through the by-pass port. The activating ball assembly includes a deformable ball of a size sufficient to engage and to be held captive by the valve seat, and a weight attached to the ball. The weight is operative to assist in movement of the assembly under the action of gravity to enrage the ball with the valve seat. The weight is of smaller transverse dimensions than the ball so as to be capable of moving downwardly though the valve seat and to null the ball into engagement with the valve seat. Additionally, the tool of the invention, which is mountable in a casing portion of a drillstring, may comprise any downhole tool which is required to be activated by the launching of a ball from the surface, but in one preferred form comprises a downhole valve of the type described in more detail in U.S. Pat. Nos. 4,889,199 and 5,499,687.

BRIEF DESCRIPTION OF THE SEVERAL VIEWS OF THE DRAWINGS

Preferred embodiments of activating ball assembly according to the invention will now be described below, with reference to the accompanying schematic drawings, in which:

FIGS. 1 to 4 are partly sectional side views of a downhole valve for use in a drillstring, and to which the invention may be applied, such figures comprising the downhole device disclosed in more detail in U.S. Pat. No. 4,889,199.

DETAILED DESCRIPTION OF THE INVENTION

Figure 7:
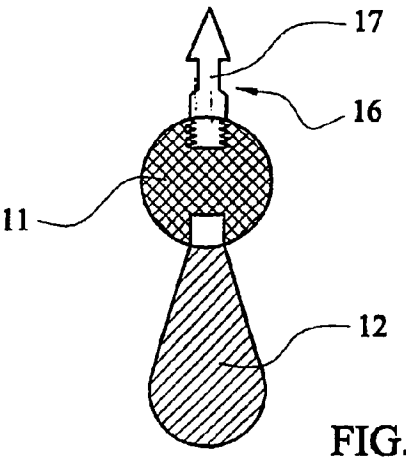
FIG. 7 is a side view of a third embodiment, having means to facilitate retrieval of the ball assembly using a wireline-delivered retrieval tool.

Referring now to the drawings, there will be described embodiments of activating ball assembly for use with a by-pass tool incorporated in a drill string, and typically a by-pass tool of the type described and illustrated in U.S. Pat. No. 4,889,199, to which reference is directed.

The downhole device disclosed in U.S. Pat. No. 4,889,199, will now be described briefly, with reference to FIGS. 1 to 4, to give one example of a downhole tool to which the invention may be applied.

With reference to FIGS. 1 to 4 the downhole device is a bypass sub defined by a tubular casing (1) with an internally threaded top end (2), and an externally threaded bottom end (3) for mounting the casing (1) in a drill string. An outlet opening (5) is provided on one side of the casing (1) for discharging fluid from the interior of the casing. The opening (5) is normally closed by a sleeve (6) which is slidably mounted in the casing (1). O rings (7) above and below the opening (5) provide fluid seals between the casing (1) and the sleeve (6). The sleeve (6) is retained in the casing (1) by a retainer ring (9) mounted in the casing beneath the threaded top end (2) thereof. Downward movement of the sleeve (6) in the casing is limited by a shoulder (10) on the sleeve (6) and a ledge (12) on the interior of the casing (1). Vertical movement of an annular floating piston (13) is facilitated by movement of the sleeve (6). A chamber containing a spring (16), i.e. the chamber defined by the bottom, outer wall of the sleeve (6), the interior casing (1), the shoulder (10) and an annular ledge (17) contains hydraulic fluid. Rotation of the sleeve (6) in the casing (1) is prevented by a guide pin (14) extending radially inwardly through the casing (1) into a longitudinally extending slot (not shown) in the outer surface of the sleeve (6). The sleeve (6) is biassed to the closed position over the opening (5) by the helical spring (16), which extends between the shoulder (10) and the annular ledge (17) above the guide pin (14). An outlet opening (18) is provided in one or more sides of the sleeve (6) the outlet opening (18) being vertically aligned with the opening (5) in the casing (1).

During a lost circulation condition i.e. when drilling fluid is being lost to the formation, and it is desired to inject lost circulation material into the formation, the drillstring is broken at the surface, and a large plastic ball (20) is placed therein. The ball (20) descends to the casing (1) (i.e. to the bypass sub). The ball (20) can be pumped through a portion of the drillstring above the casing (1) in order to speed-up feeding of the ball. However, pumping should be stopped at least two barrels before the ball (20) reaches the casing (1) (FIG. 2). Subsequently, the ball engages an inwardly inclined shoulder (21) on the interior of the sleeve (6). The pump pressure in the drillstring causes the ball (20) to push the sleeve (6) downwardly against the force of the spring (16) until the shoulder (10) engages the ledge (12). In this position, the openings (5) and (18) are aligned, so that lost circulation material such as woodchips can be discharged into the formation. Once the formation has been sealed, the string is again broken at the surface, and a smaller metal ball (23) (FIG. 3) is dropped into the string. Pumping is then continued to cause the metal ball (23) to bear against the opening (18). Continued pumping of drilling mud into the casing (1) forces the balls (20) and (23) downwardly through the sleeve (6) into a ball catcher device generally indicated at (25). This procedure can be repeated as often as necessary. It is necessary to ensure that all of the loose circulation material is discharged from the casing (1) in order to prevent plugging of the bit jets (not shown).

Figure 5:
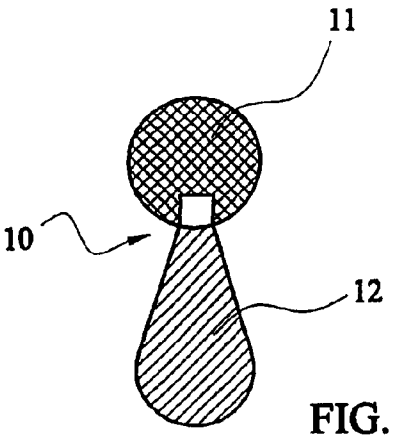
FIG. 5 is a side view of a first embodiment, comprising a hollow ball rigidly attached to a weight.

In FIG. 5, there is shown a first embodiment of activating ball assembly according to the invention, designated generally by reference 10. The assembly comprises a large deformable ball 11, which is similar to the ball 20 disclosed in the U.S. patent. The ball 11 is therefore of a size sufficient to engage and to be held captive by the valve seat which it engages in order to activate the by-pass tool, but is deformable so as to subsequently be capable of being forced downwardly through the valve seat after launching of a second and smaller hard de-activating ball.

A weight 12 is attached to the ball 11, preferably by a threaded connection and augmented by adhesive. The weight 12 is made of non-magnetic material, of which a suitable material is brass.

The weight 12 is operative to assist in movement of the assembly 10 under the action of gravity to engage the ball 11 with the valve seat, and in that at least a central core of the weight 12 is of smaller transverse dimensions than the ball (and with any outer portion of the weight provided being of deformable material), the weight is capable of moving downwardly through the valve seat and in order to pull the ball 11 into engagement with the valve seat.

The weight 12 is therefore mainly solid and un-deformable, and may take the form of a "dart" when attached to the ball.

The weight 12 may have outwardly projecting fins which increase its overall transverse dimensions, but such fins are made to be at least partly deformable so that the weight plus the fins can pass downwardly through the valve seat. The fins may be made of elastomeric material, and function as wiper blades during the descent of the ball assembly down the drill string and/or down the valve seat.

Figure 6:
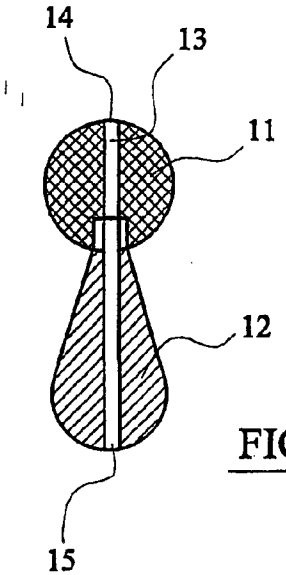
FIG. 6 is a view, similar to FIG. 5, showing a preferred additional feature provided in the assembly of FIG. 5.

The ball 11 is hollow, and spherical in shape, and is therefore able to make a complete seal with the valve seat, as shown in e.g. FIG. 5. In such a position, it prevents through flow passage of fluid (mud) through the housing of the by-pass tool, and all of the fluid is diverted to pass to the by-pass port However, in some circumstances, it may be desirable to permit a limited proportion of the fluid to continue to flow through the housing, although a major portion of the fluid is still directed to the by-pass port. This may be achieved by the second embodiment which is shown in FIG. 6, in which an open ended narrow passage 13 extends lengthwise of the ball 11 and the weight 12 between an inlet end 14 in the ball 11 and an outlet 15 in the weight 12.

In a third embodiment, as shown in FIG. 7, means 16 is provided to facilitate unseating of the assembly, if desired, by use of a wireline-delivered retrieval tool. The means 16 comprises a suitable hook-shape, and preferably takes the form of a "fishing neck" 17 which is secured to the side of the ball 11 which is opposite to the side of the ball to which the weight 12 is attached.

Figure 8:
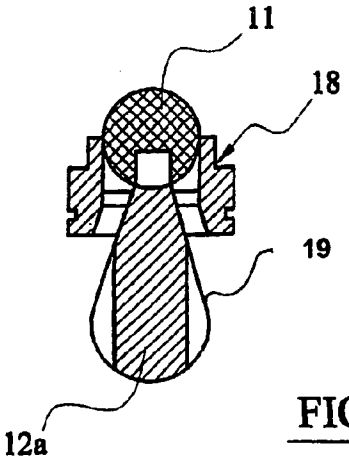
FIG. 8 is a vertical sectional view illustrating how a fourth embodiment of ball assembly can become seated on a valve seat of a shiftable sleeve within a through flow housing of a by-pass tool.

In the embodiment shown in FIG. 8, the solid core 12*a* of the weight has smaller transverse dimensions than the diameter of the valve seat 18, but has resiliently deformable fins 19 projecting outwardly therefrom. These function as wiper blades during the descent down the drill string and the downward forced movement through the valve seat 18, which is permitted by their deformability. Also, this shows the ball dart assembly assembled with the ball seat between the two, locking the ball and dart to the seat. This assembly also allows for fluid to flow from the bottom up, as the dart will not seal on the bottom of the seat. The flutes cut into the seat and will allow the fluid to flow up when the ball is unseated and when the fluid flows from the top the ball will seat and seal on the seat. This will be useful if the operator wants the drill string to fill as the pipe is lowered into the hole but wants to stop the ball from migrating up the pipe with the fluid.

Figure 9:
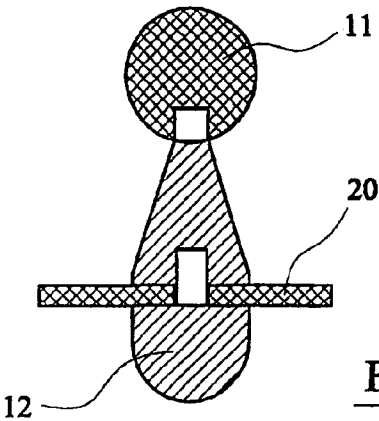
FIG. 9 is a side view of a further embodiment, having a transversely extending baffle provided on the weight, to act as wiper blades.

In the embodiment shown in FIG. 9, the weight 12 has a transversely extending baffle 20, which is resiliently deformable, and therefore allows the weight to be forced downwardly through the valve seat in order to bring the ball 11 into engagement with the seat. The baffle 20 facilitates pumped driving of the assembly along non-vertical sections of the path of the drill string, and which may include horizontal or near horizontal sections.

Finally, referring to FIGS. 10*a*, 10*b* and 11*a* and 11*b*, there is show a further embodiment having a self-locking facility, after it engages the valve seat.

Figure 10A:
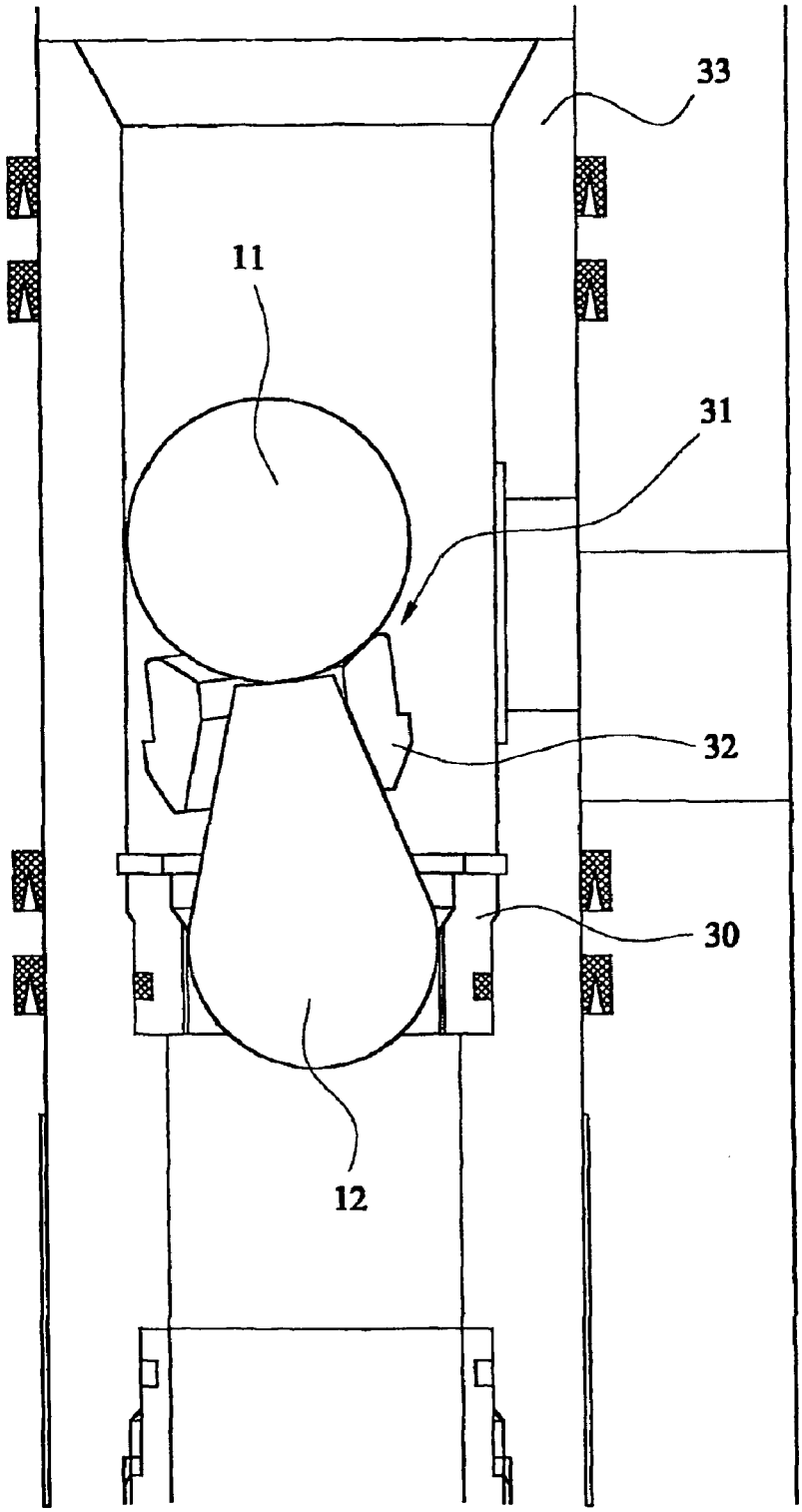
FIG. 10*a* is a side view of a still further embodiment, travelling down the drill string, and prior to engagement with the valve seat.
Figure 10B:
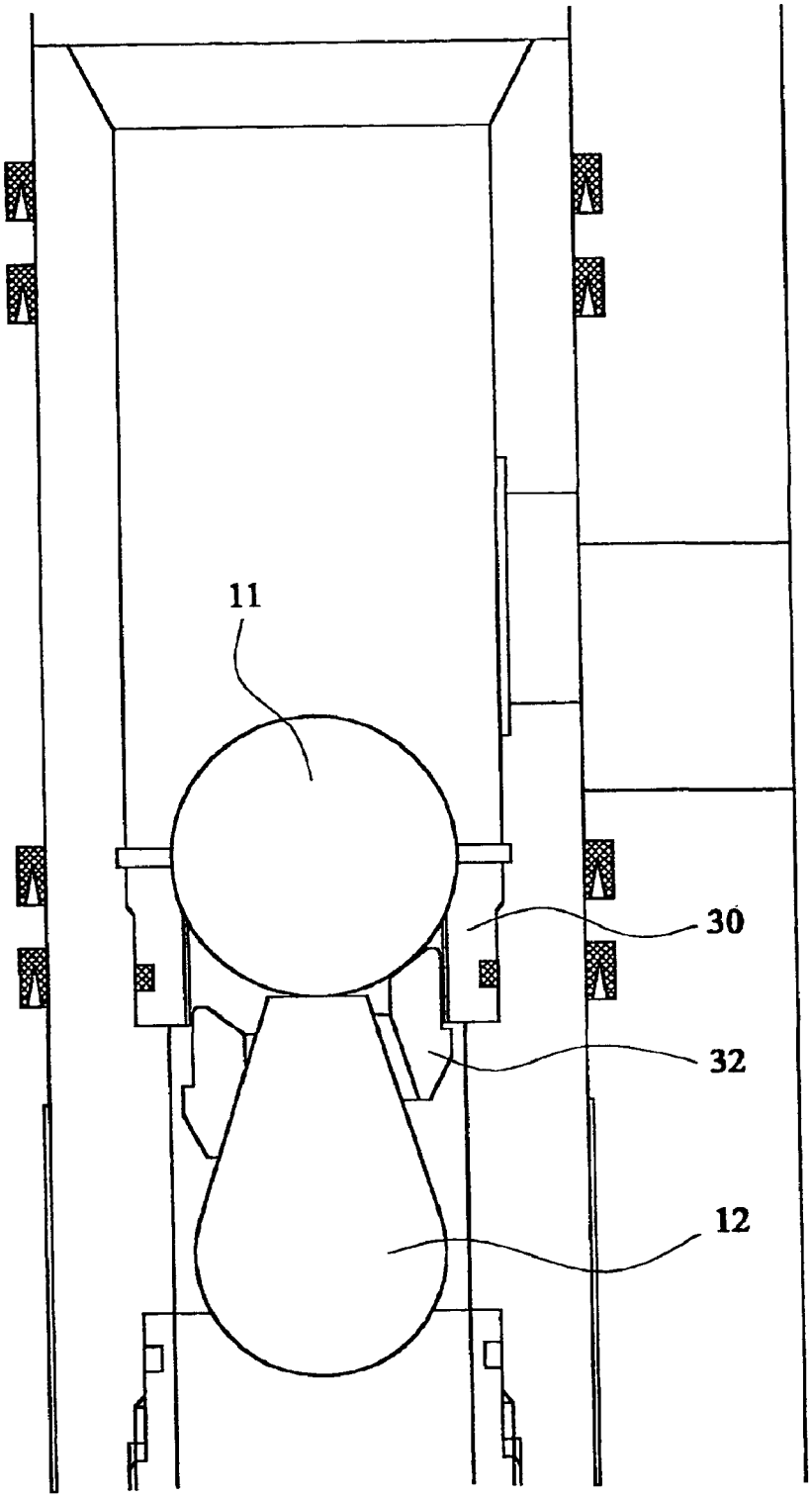
FIG. 10*b* shows the engagement with the valve seat.

FIG. 10*a* shows the ball dart assembly travelling down a drill string, and which, as illustrated, is partly deviated from the vertical. The ball dart assembly is shown as it moves into engagement with valve seat 30, which is part of a by-pass tool incorporated in the drill string, and of the general type known from e.g. U.S. Pat. No. 4,889,199. The ball dart assembly is designated generally by reference 31, and comprises large deformable ball 11 and dart 12, and which move into engagement with the valve seat 30 in generally similar manner to that described above for the previous embodiments. FIG. 10*b* shows the assembly 31 after it has moved into full sealing engagement with the valve seat 30.

Figure 11A:
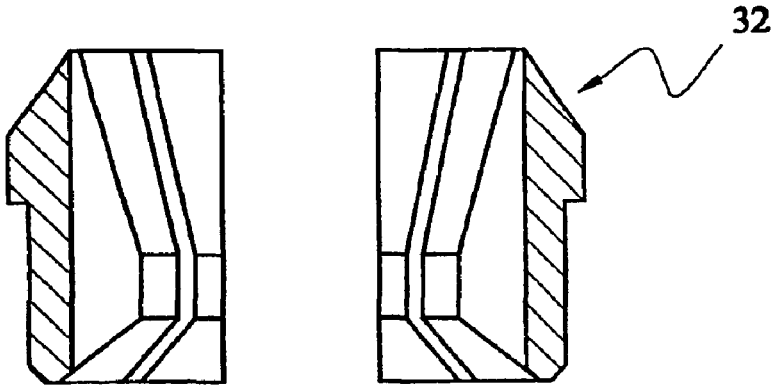
FIGS. 11*a* and 11*b* are side and plan views of a deformable locking collet for use with the ball dart assembly, to lock the assembly to the valve seat.
Figure 11B:
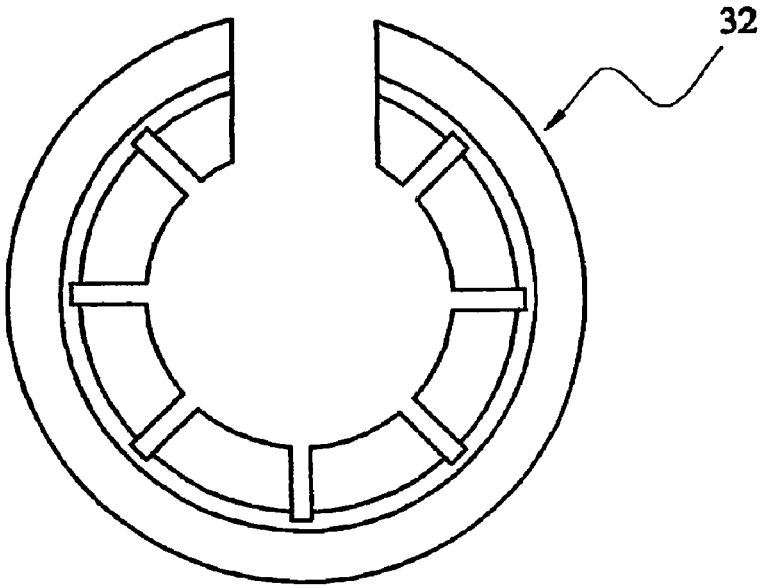

The assembly 31 includes a locking collet 32 which comprises a deformable split ring, as shown in FIGS. 11*a* and 11*b*, and which is movable downwardly through the valve seat 30, and then makes snap fitting engagement, as shown in FIG. 10*b*, which resists any tendency for the ball 11 to become unseated, and to move upwardly away from the seat 30.

Therefore, when the assembly 31 travels down the drill string, shown by reference 33, it is pumped downwardly into the down hole tool. When the assembly 31 reaches the tool (valve seat 30), the split ring 32 deforms as it passes downwardly through the valve seat 30, and then locks the assembly 31 to the seat 30. This maintains the assembly 31 locked in position, and the tool then operates in the by-pass mode i.e. the by-pass port is effectively locked in the open position, until such time as the ball 11 is blown downwardly through the valve seat 30 upon deactivation of the tool by launching of the small second hard ball.

In the absence of the locking collet or ring 32, there may be a tendency for the ball 11 to become unseated e.g. in the event of a pressure loss. However, upon deactivation, the entire assembly 31, including the locking collet 32, passes downwardly through the tool to be caught by a suitable catcher device (not shown).

What is claimed:

1. An activating ball assembly for use with a by-pass tool incorporated in a drill string, said tool having:

a through-flow housing through which drilling mud can flow when the tool is deactivated;

a control sleeve movable lengthwise of the tool between a through-flow mode and a by-pass mode;

a by-pass port in the tool through which mud can flow when the sleeve is in its by-pass mode; and, a valve seat which is engageable by the activating ball assembly in order to move its sleeve to its by-pass mode and thereby divert the mud from flow through the housing to by-pass flow through the by-pass port;

and in which the activating ball assembly comprises:

a deformable ball of a size sufficient to engage and to be held captive by the valve seat; and a weight attached to the ball and operative to assist in movement of the assembly under the action of gravity to engage the ball with the valve seat, said weight being of smaller transverse dimensions than the ball so as to be capable of moving downwardly through the valve seat and to pull the ball into engagement with the valve seat, in which an open ended throughflow passage extends lengthwise of the ball assembly between an inlet end in the ball and an outlet end in the weight, to allow a limited proportion of fluid to continue to flow through the housing when the ball is seated on the valve seat.

2. An activating ball assembly according to claim 1, in which the weight is solid and undeformable.

3. An activating ball assembly according to claim 2, in which the weight has outwardly projecting fins which increase its overall transverse dimensions, said fins being made to be at least partly deformable so that the weight plus the fins can pass downwardly through the valve seat.

4. An activating ball assembly according to claim 3, in which the fins are made of elastomeric material, and function as wiper blades during the dissent of the ball assembly down the drill string and/or down through the valve seat.

5. An activating ball assembly according to claim 1, in which the ball is hollow, and is able to make a substantially complete seal with the valve seat and thereby prevent thoughflow passage of fluid through the housing, and divert all of the fluid to flow via the by-pass port.

6. An activating ball assembly according to claim 1, in which means is provided on the ball to facilitate unseating of the ball from the valve seat by use of a wireline-delivered retrieval tool.

7. An activating ball assembly according to claim 6, in which a "fishing neck" is provided on the ball to facilitate unseating of the ball.

8. An activating ball assembly according to claim 1, in which the weight is provided with a laterally projecting baffle which facilitates pump-driven conveyance of the ball assembly.

9. An activating ball assembly according to claim 8, in which the baffle is resiliently deformable, and allows the weight to be forced downwardly through the valve seat in order to bring the ball into engagement with the seat.

10. An activating ball assembly according to claim 1, in which the bail and weight assembly has a deformable locking collet which is movable through the valve seat in order to lock the ball in position on the valve seat.

11. An activating ball assembly according to claim 10, in which the deformable collet is a split ring.

12. A by-pass tool which is intended to be incorporated in a drill string, in combination with an activating ball assembly which is operative to adjust the tool between an activated mode and a de-activated mode, said tool having:

a through-flow housing through which drilling mud can flow when the tool is deactivated;

a control sleeve movable lengthwise of the tool between a through-flow mode and a by-pass mode;

a by-pass port in the tool through which mud can flow when the sleeve is in its by-pass mode; and, a valve seat which is engageable by the activating ball assembly in order to move its sleeve to its by-pass mode and thereby divert the mud from flow through the housing to by-pass flow through the by-pass port;

and in which the activating ball assembly comprises:

a deformable ball of a size sufficient to engage and to be held captive by the valve seat; and a weight attached to the ball and operative to assist in movement of the assembly under the action of gravity to engage the ball with the valve seat, said weight being of smaller transverse dimensions than the ball so as to be capable of moving downwardly through the valve seat and to pull the ball into engagement with the valve seat, in which an open ended throughflow passage extends lengthwise of the ball assembly between an inlet end in the ball and an outlet end in the weight, to allow a limited proportion of fluid to continue to flow through the housing when the ball is seated on the valve seat.

13. A by-pass tool according to claim 12, in which the weight is solid and undeformable.

14. A by-pass tool according to claim 13, in which the weight has outwardly projecting fins which increase its overall transverse dimensions, said fins being made to be at least partly deformable so that the weight plus the fins can pass downwardly through the valve seat.

15. A by-pass tool according to claim 14, in which the fins are made of elastomeric material, and function as wiper blades during the dissent of the ball assembly down the drill string and/or down through the valve seat.

16. A by-pass tool according to claim 12, in which the ball is hollow, and is able to make a substantially complete seal with the valve seat and thereby prevent throughflow passage of fluid through the housing, and divert all of the fluid to flow via the by-pass port.

17. A by-pass tool according to claim 12, in which means is provided on the ball to facilitate unseating of the ball from the valve seat by use of a wireline-delivered retrieval tool.

18. A by-pass tool according to claim 17, in which a "fishing neck" is provided on the ball to facilitate unseating of the ball.

19. A by-pass tool according to claim 12, in which the weight is provided with a laterally projecting baffle which facilitates pump-driven conveyance of the ball assembly.

20. A by-pass tool according to claim 19, in which the baffle is resiliently deformable, and allows the weight to be forced downwardly through the valve seat in order to bring the ball into engagement with the seat.

21. A by-pass tool according to claim 12, in which the ball and weight assembly has a deformable locking collet which is movable through the valve seat in order to lock to ball in position on the valve seat.

22. A by-pass tool according to claim 21, which the deformable collet is a split ring.

23. An activating ball assembly for use with a by-pass tool incorporated in a drill string, said tool having:

a through-flow housing through which drilling mud can flow when the tool is deactivated;

a control sleeve movable lengthwise of the tool between a through-flow mode and a by-pass mode;

a by-pass port in the tool through which mud can flow when the sleeve is in its by-pass mode; and, a valve seat which is engageable by the activating ball assembly in order to move its sleeve to its by-pass mode and thereby divert the mud from flow through the housing to by-pass flow through the by-pass port;

and in which the activating ball assembly comprises:

a deformable ball of a size sufficient to engage and to be held captive by the valve seat; and a weight attached to the ball and operative to assist in movement of the assembly under the action of gravity to engage the ball with the valve seat, said weight being of smaller transverse dimensions than the ball so as to be capable of moving downwardly through the valve seat and to pull the ball into engagement with the valve seat, wherein the weight is solid and undeformable, wherein the weight has outwardly projecting fins which increase its overall transverse dimensions, said fins being made to be at least partly deformable so that the weight plus the fins can pass downwardly through the valve seat.

24. A by-pass tool which is intended to be incorporated in a chill string, in combination with an activating ball assembly which is operative to adjust the tool between an activated mode and a de-activated mode, said tool having:

a through-flow housing through which drilling mud can flow when the tool is deactivated;

a control sleeve movable lengthwise of the tool between a through-flow mode and a by-pass mode;

a by-pass port in the tool through which mud can flow when the sleeve is in its by-pass mode; and, a valve seat which is engageable by the activating ball assembly in order to move its sleeve to its by-pass mode and thereby divert the mud from flow through the housing to by-pass flow through the by-pass port;

and in which the activating ball assembly comprises:

a deformable ball of a size sufficient to engage and to be held captive by the valve seat; and a weight attached to the ball and operative to assist in movement of the assembly under the action of gravity to engage the ball with the valve seat, said weight being of smaller transverse dimensions than the ball so as to be capable of moving downwardly through the valve seat and to pull the ball into engagement with the valve seat, in which the weight is solid and undeformable, wherein the weight has outwardly projecting fins which increase its overall transverse dimensions, said fins being made to be at least partly deformable so that the weight plus the fins can pass downwardly through the valve seat.

* * * * *